US010304401B2

(12) United States Patent
Zuo et al.

(10) Patent No.: US 10,304,401 B2
(45) Date of Patent: May 28, 2019

(54) DISPLAY DRIVING CIRCUIT AND LIQUID CRYSTAL DISPLAY PANEL

(71) Applicant: Wuhan China Star Optoelectronics Technology Co., Ltd., Wuhan (CN)

(72) Inventors: Qingcheng Zuo, Wuhan (CN); Man Li, Wuhan (CN); Xiaoling Yuan, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 181 days.

(21) Appl. No.: 15/516,898

(22) PCT Filed: Mar. 15, 2017

(86) PCT No.: PCT/CN2017/076772

§ 371 (c)(1),
(2) Date: Apr. 5, 2017

(87) PCT Pub. No.: WO2018/145347

PCT Pub. Date: Aug. 16, 2018

(65) Prior Publication Data

US 2019/0096344 A1 Mar. 28, 2019

(30) Foreign Application Priority Data

Feb. 7, 2017 (CN) ..... 2017 1 0067468

(51) Int. Cl.
*G09G 3/36* (2006.01)

(52) U.S. Cl.
CPC ... *G09G 3/3648* (2013.01); *G09G 2300/0814* (2013.01); *G09G 2310/0289* (2013.01); *G09G 2310/0297* (2013.01)

(58) Field of Classification Search
CPC ..... G09G 3/3648; G09G 2300/0814; G09G 2310/0289; G09G 2310/0297
See application file for complete search history.

(56) References Cited

U.S. PATENT DOCUMENTS

| | | | | |
|---|---|---|---|---|
| 2017/0004798 | A1* | 1/2017 | Park | G09G 3/3648 |
| 2017/0092178 | A1* | 3/2017 | Lee | H01L 27/1225 |
| 2017/0116910 | A1* | 4/2017 | Miao | G09G 3/2092 |
| 2018/0174533 | A1* | 6/2018 | An | G09G 3/3607 |

* cited by examiner

*Primary Examiner* — Peter D McLoone
(74) *Attorney, Agent, or Firm* — Leong C. Lei

(57) ABSTRACT

The present invention provides a display driving circuit and a liquid crystal display panel with adding a first AND gate (AND1), a second AND gate (AND2) and a third AND gate (AND3). Two input ends of each of the three gates receives a branch control signal and a conditioning signal (BURR), and the conditioning signal (BURR) first performs several high and low voltage level conversions and then maintains the high voltage level, respectively in the high voltage level durations of the respective branch control signals to make the signal outputted by the output end of the first AND gate, the signal outputted by the output end of the second AND gate and the signal outputted by the output end of the third AND gate first perform several high and low voltage level conversions and then maintain the high voltage level.

13 Claims, 8 Drawing Sheets

DISPLAY DRIVING CIRCUIT AND LIQUID CRYSTAL DISPLAY PANEL

FIELD OF THE INVENTION

The present invention relates to a display technology field, and more particularly to a display driving circuit and a liquid crystal display panel.

BACKGROUND OF THE INVENTION

The Liquid Crystal Display (LCD) comprises a plurality of pixels arranged in array, and each pixel generally comprises sub pixels of red, green, blue, three colors. Each sub pixel is controlled by one scan line and one data line. The scan line is employed to control the on and off of the sub pixel, and the data line applies various data voltage signals to make the sub pixel show various gray scales, and thus for realizing the full color image display.

With the development of the liquid crystal display technology, the demand of the people for the LCD display screen is growing, but the requirement of the display resolution is getting higher and higher, the pursuit of the image display quality gets more and more stringent. Thus, how to promote the image display quality to improve the signal quality of each input and output signal unit, becomes a subject worthy of research and discussion.

For decreasing the wiring layout, most of the present LCDs utilize the multiplex (MUX) display driving circuit. Please refer to FIG. 1, which is a multiplex type display driving circuit according to prior art, comprising:

a plurality of pixel units P arranged in array, scan lines set corresponding to each row of pixel units P, data lines set corresponding to each column of pixel units P and multiplex modules DM set corresponding to each column of pixel units P.

Each pixel unit P comprising a red sub pixel R, a green sub pixel G and a blue sub pixel B which are aligned from left to right in order, and a first switch TFT T1 electrically coupled to the red sub pixel R, a second switch TFT T2 electrically coupled to the green sub pixel G, a third switch TFT T3 electrically coupled to the blue sub pixel B; each multiplex module DM comprising a first control TFT T10, a second control TFT T20 and a third control TFT T30 respectively set corresponding to a red sub pixel R column, a green sub pixel G column and a blue sub pixel B column.

n, m are set to be positive integers, and for the pixel unit P of a nth row, a mth column: all of a gate of the first switch TFT T1, a gate of the second switch TFT T2 and a gate of the third switch TFT T3 being electrically coupled to a nth scan line G(n) set corresponding to a nth row of pixel units P, and a source of the first switch TFT T1, a source of the second switch TFT T2 and a source of the third switch TFT T3 being electrically coupled to a drain of the first control TFT T10, a drain of the second control TFT T20 and a drain of the third control TFT T30 in a mth multiplex module DM set corresponding to a mth column of pixel units P, respectively, and a drain of the first switch TFT T10, a drain of the second switch TFT T20 and a drain of the third switch TFT T30 being electrically coupled to the red sub pixel R, the green sub pixel G and the blue sub pixel B, respectively. For the mth multiplex module DM: a gate of the first control TFT T10, a gate of the second control TFT T20 and a gate of the third control TFT T30 respectively receiving a first branch control signal MUXR, a second branch control signal MUXG and a third branch control signal MUXB, and all of a source of the first control TFT T10, a source of the second control TFT T20 and a source of the third control TFT T30 being electrically coupled to a mth data line D(m) set corresponding to the mth column of pixel units P.

With combination of FIG. 1 and FIG. 2, the working procedure of the multiplex type display driving circuit according to prior art is:

step S100, the scan signal in the nth scan line G(n) is changed from low to high, all of the first switch TFTs T1, the second switch TFTs T2 and the third switch TFTs T3 of the nth row are on, and after the duration Δt, the first branch control signal MUXR is pulled high, and then, all of the first control TFTs T10 are on, and the data signals in the respective data lines start to charge all of the red sub pixels R of the nth row via the first control TFTs 10 and the first switch TFTs T1 which are on.

step S200, after charging all of the red sub pixels R is accomplished, the first branch control signal MUXR is pulled down, and after the duration Δt, the second branch control signal MUXG is pulled high, and then, all of the second control TFTs T20 are on at the same time, and the data signals in the respective data lines start to charge all of the green sub pixels G of the nth row via the second control TFTs 20 and the second switch TFTs T2 which are on.

step S300, after charging all of the green sub pixels G is accomplished, the second branch control signal MUXG is pulled down, and after the duration Δt, the third branch control signal MUXB is pulled high, and then, all of the third control TFTs T30 are on at the same time, and the data signals in the respective data lines start to charge all of the blue sub pixels B of the nth row via the third control TFTs 30 and the third switch TFTs T3 which are on.

step S400, after charging all of the blue sub pixels B is accomplished, the third branch control signal MUXB is pulled down, and after the duration Δt, the scan signal in the nth scan line G(n) is pulled down to complete the signal charging of one row cycle.

step S500, then, the scan signal in the next scan line is changed from low to high, and the aforesaid step S100 to step S400 are repeated to complete charging the entire LCD.

In the duration that the scan signal of one row is pulled high, the present multiplex type display driving circuit respectively and successively pulls up the first branch control signal MUXR, the second branch control signal MUXG, the third branch control signal MUXB to complete the charging to the red sub pixels R, the green sub pixels G, the blue sub pixels B of one row. However, as the first branch control signal MUXR (or the second branch control signal MUXG or the third branch control signal MUXB) is pulled high, all of the red sub pixels (or the green sub pixels G or the blue sub pixels B) of the corresponding row are in the larger current charging state to result in that the liquid crystal module (LCM) instantly forms a larger current pumping to the driving integrated circuit (IC) of the liquid crystal panel to lead to the IC output. Namely, the actual input signal of the driving circuit appears the glitch shown in FIG. 3.

SUMMARY OF THE INVENTION

An objective of the present invention is to provide a display driving circuit, which can avoid the signal glitch due to the overloading to improve the signal quality.

Another objective of the present invention is to provide a liquid crystal display, of which the signal glitch is less, and the signal quality is higher, and the image display quality is better.

For realizing the aforesaid objectives, the present invention first provides a display driving circuit, comprising a plurality of pixel units arranged in array, scan lines set corresponding to each row of pixel units, data lines set corresponding to each column of pixel units, multiplex modules set corresponding to each column of pixel units, and a first AND gate, a second AND gate and a third AND gate;

two input ends of the first AND gate respectively receiving a first branch control signal and a conditioning signal, and two input ends of the second AND gate respectively receiving a second branch control signal and a conditioning signal, and two input ends of the third AND gate respectively receiving a third branch control signal and a conditioning signal;

each pixel unit comprising a red sub pixel, a green sub pixel and a blue sub pixel which are aligned from left to right in order, and a first switch TFT electrically coupled to the red sub pixel, a second switch TFT electrically coupled to the green sub pixel, a third switch TFT electrically coupled to the blue sub pixel; each multiplex module comprising a first control TFT, a second control TFT and a third control TFT respectively set corresponding to a red sub pixel column, a green sub pixel column and a blue sub pixel column;

n, m are set to be positive integers, and for the pixel unit of a nth row, a mth column: all of a gate of the first switch TFT, a gate of the second switch TFT and a gate of the third switch TFT being electrically coupled to a nth scan line set corresponding to a nth row of pixel units, and a source of the first switch TFT, a source of the second switch TFT and a source of the third switch TFT being electrically coupled to a drain of the first control TFT, a drain of the second control TFT and a drain of the third control TFT in a mth multiplex module set corresponding to a mth column of pixel units, respectively, and a drain of the first switch TFT, a drain of the second switch TFT and a drain of the third switch TFT being electrically coupled to the red sub pixel, the green sub pixel and the blue sub pixel, respectively;

for the mth multiplex module: a gate of the first control TFT, a gate of the second control TFT and a gate of the third control TFT being electrically coupled to an output end of the first AND gate, an output end of the second AND gate and an output end of the third AND gate, respectively, and all of a source of the first control TFT, a source of the second control TFT and a source of the third control TFT being electrically coupled to a mth data line set corresponding to the mth column of pixel units.

A high voltage level duration of the scan signal in the nth scan line is larger than a sum of a high voltage level duration of the first branch control signal, a high voltage level duration of the second branch control signal and a high voltage level duration of the third branch control signal; the conditioning signal first performs several high and low voltage level conversions and then maintains the high voltage level, respectively in the high voltage level duration of the first branch control signal, the high voltage level duration of the second branch control signal and the high voltage level duration of the third branch control signal, and correspondingly makes a signal outputted by the output end of the first AND gate, a signal outputted by the output end of the second AND gate and a signal outputted by the output end of the third AND gate first perform several high and low voltage level conversions and then maintain the high voltage level.

In a process that the conditioning signal performs several high and low voltage level conversions, both a high voltage level duration and a low voltage level duration are default durations.

The first branch control signal, the second branch control signal and the third branch control signal are generated in time sequence, and a rising edge of the second branch control signal is later than a falling edge of the first branch control signal, and a rising edge of the third branch control signal is later than a falling edge of the second branch control signal.

All of the first switch TFT, the second switch TFT, the third switch TFT, the first control TFT, the second control TFT and the third control TFT are low temperature polysilicon TFTs, oxide semiconductor TFTs or amorphous silicon TFTs.

The present invention further provides a liquid crystal display panel, comprising a display driving circuit, and the display driving circuit comprising a plurality of pixel units arranged in array, scan lines set corresponding to each row of pixel units, data lines set corresponding to each column of pixel units, multiplex modules set corresponding to each column of pixel units, and a first AND gate, a second AND gate and a third AND gate;

two input ends of the first AND gate respectively receiving a first branch control signal and a conditioning signal, and two input ends of the second AND gate respectively receiving a second branch control signal and a conditioning signal, and two input ends of the third AND gate respectively receiving a third branch control signal and a conditioning signal;

each pixel unit comprising a red sub pixel, a green sub pixel and a blue sub pixel which are aligned from left to right in order, and a first switch TFT electrically coupled to the red sub pixel, a second switch TFT electrically coupled to the green sub pixel, a third switch TFT electrically coupled to the blue sub pixel; each multiplex module comprising a first control TFT, a second control TFT and a third control TFT respectively set corresponding to a red sub pixel column, a green sub pixel column and a blue sub pixel column;

n, m are set to be positive integers, and for the pixel unit of a nth row, a mth column: all of a gate of the first switch TFT, a gate of the second switch TFT and a gate of the third switch TFT being electrically coupled to a nth scan line set corresponding to a nth row of pixel units, and a source of the first switch TFT, a source of the second switch TFT and a source of the third switch TFT being electrically coupled to a drain of the first control TFT, a drain of the second control TFT and a drain of the third control TFT in a mth multiplex module set corresponding to a mth column of pixel units, respectively, and a drain of the first switch TFT, a drain of the second switch TFT and a drain of the third switch TFT being electrically coupled to the red sub pixel, the green sub pixel and the blue sub pixel, respectively;

for the mth multiplex module: a gate of the first control TFT, a gate of the second control TFT and a gate of the third control TFT being electrically coupled to an output end of the first AND gate, an output end of the second AND gate and an output end of the third AND gate, respectively, and all of a source of the first control TFT, a source of the second control TFT and a source of the third control TFT being electrically coupled to a mth data line set corresponding to the mth column of pixel units.

A high voltage level duration of the scan signal in the nth scan line is larger than a sum of a high voltage level duration of the first branch control signal, a high voltage level duration of the second branch control signal and a high voltage level duration of the third branch control signal; the conditioning signal first performs several high and low voltage level conversions and then maintains the high voltage level, respectively in the high voltage level duration of the first branch control signal, the high voltage level duration of the second branch control signal and the high voltage level duration of the third branch control signal, and correspondingly makes a signal outputted by the output end of the first AND gate, a signal outputted by the output end of the second AND gate and a signal outputted by the output end of the third AND gate first perform several high and low voltage level conversions and then maintain the high voltage level.

In a process that the conditioning signal performs several high and low voltage level conversions, both a high voltage level duration and a low voltage level duration are default durations.

The first branch control signal, the second branch control signal and the third branch control signal are generated in time sequence, and a rising edge of the second branch control signal is later than a falling edge of the first branch control signal, and a rising edge of the third branch control signal is later than a falling edge of the second branch control signal.

All of the first switch TFT, the second switch TFT, the third switch TFT, the first control TFT, the second control TFT and the third control TFT are low temperature poly-silicon TFTs, oxide semiconductor TFTs or amorphous silicon TFTs.

The present invention further provides a liquid crystal display panel, comprising a display driving circuit, and the display driving circuit comprising a plurality of pixel units arranged in array, scan lines set corresponding to each row of pixel units, data lines set corresponding to each column of pixel units, multiplex modules set corresponding to each column of pixel units, and a first AND gate, a second AND gate and a third AND gate;

two input ends of the first AND gate respectively receiving a first branch control signal and a conditioning signal, and two input ends of the second AND gate respectively receiving a second branch control signal and a conditioning signal, and two input ends of the third AND gate respectively receiving a third branch control signal and a conditioning signal;

each pixel unit comprising a red sub pixel, a green sub pixel and a blue sub pixel which are aligned from left to right in order, and a first switch TFT electrically coupled to the red sub pixel, a second switch TFT electrically coupled to the green sub pixel, a third switch TFT electrically coupled to the blue sub pixel; each multiplex module comprising a first control TFT, a second control TFT and a third control TFT respectively set corresponding to a red sub pixel column, a green sub pixel column and a blue sub pixel column;

n, m are set to be positive integers, and for the pixel unit of a nth row, a mth column: all of a gate of the first switch TFT, a gate of the second switch TFT and a gate of the third switch TFT being electrically coupled to a nth scan line set corresponding to a nth row of pixel units, and a source of the first switch TFT, a source of the second switch TFT and a source of the third switch TFT being electrically coupled to a drain of the first control TFT, a drain of the second control TFT and a drain of the third control TFT in a mth multiplex module set corresponding to a mth column of pixel units, respectively, and a drain of the first switch TFT, a drain of the second switch TFT and a drain of the third switch TFT being electrically coupled to the red sub pixel, the green sub pixel and the blue sub pixel, respectively;

for the mth multiplex module: a gate of the first control TFT, a gate of the second control TFT and a gate of the third control TFT being electrically coupled to an output end of the first AND gate, an output end of the second AND gate and an output end of the third AND gate, respectively, and all of a source of the first control TFT, a source of the second control TFT and a source of the third control TFT being electrically coupled to a mth data line set corresponding to the mth column of pixel units;

wherein a high voltage level duration of the scan signal in the nth scan line is larger than a sum of a high voltage level duration of the first branch control signal, a high voltage level duration of the second branch control signal and a high voltage level duration of the third branch control signal; the conditioning signal first performs several high and low voltage level conversions and then maintains the high voltage level, respectively in the high voltage level duration of the first branch control signal, the high voltage level duration of the second branch control signal and the high voltage level duration of the third branch control signal, and correspondingly makes a signal outputted by the output end of the first AND gate, a signal outputted by the output end of the second AND gate and a signal outputted by the output end of the third AND gate first perform several high and low voltage level conversions and then maintain the high voltage level;

wherein all of the first switch TFT, the second switch TFT, the third switch TFT, the first control TFT, the second control TFT and the third control TFT are low temperature poly-silicon TFTs, oxide semiconductor TFTs or amorphous silicon TFTs.

The benefits of the present invention are: the present invention provides a display driving circuit and a liquid crystal display panel. On the basis of the present multiplex type display driving circuit, the first AND gate, the second AND gate and the third AND gate are added, and two input ends of the first AND gate respectively receiving a first branch control signal and a conditioning signal, and two input ends of the second AND gate respectively receiving a second branch control signal and a conditioning signal, and two input ends of the third AND gate respectively receiving a third branch control signal and a conditioning signal; the conditioning signal first performs several high and low voltage level conversions and then maintains the high voltage level, respectively in the high voltage level duration of the first branch control signal, the high voltage level duration of the second branch control signal and the high voltage level duration of the third branch control signal, and correspondingly makes a signal outputted by the output end of the first AND gate, a signal outputted by the output end of the second AND gate and a signal outputted by the output end of the third AND gate first perform several high and low voltage level conversions and then maintain the high voltage level. Due to the resistance-capacitance delay characteristic of the wiring of the circuit itself, the first control TFT, the second control TFT, the third control TFT, which are respectively controlled by the signal outputted by the output end of the first AND gate, the signal outputted by the output end of the second AND gate and the signal outputted by the output end of the third AND gate have different on states at the signal near end and at the signal remote end so that the times that the respective sub pixels appear the maximum current at the signal near end and at the signal remote end are not consistent, and thus to avoid the signal glitch formed by the instant overloading to improve the signal quality and to promote the image display quality.

BRIEF DESCRIPTION OF THE DRAWINGS

In order to better understand the characteristics and technical aspect of the invention, please refer to the following detailed description of the present invention is concerned with the diagrams, however, provide reference to the accompanying drawings and description only and is not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
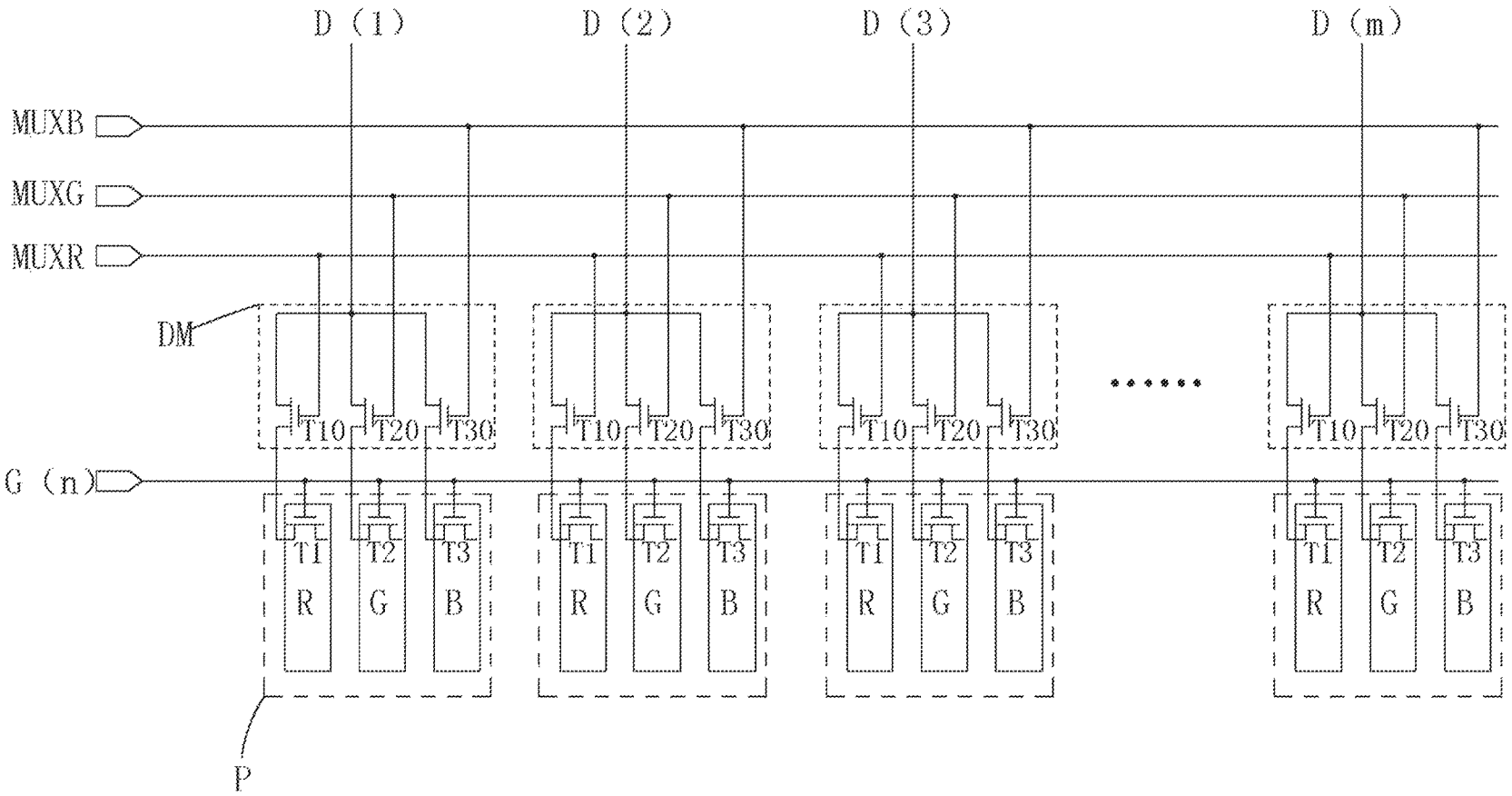
Fig. 1 (PRIOR ART)
FIG. 1 is a circuit diagram of a multiplex type display driving circuit according to prior art.
Figure 2:
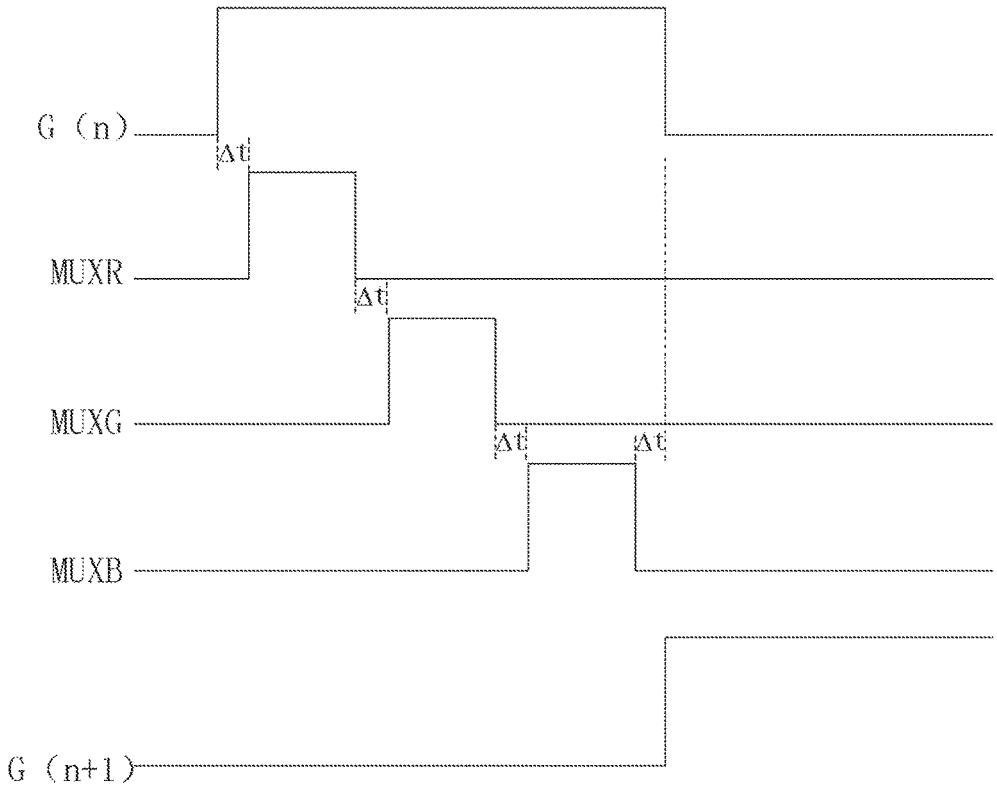
Fig. 2 (PRIOR ART)
FIG. 2 is a sequence diagram corresponding to the multiplex type display driving circuit according to prior art shown in FIG. 1.
Figure 3:
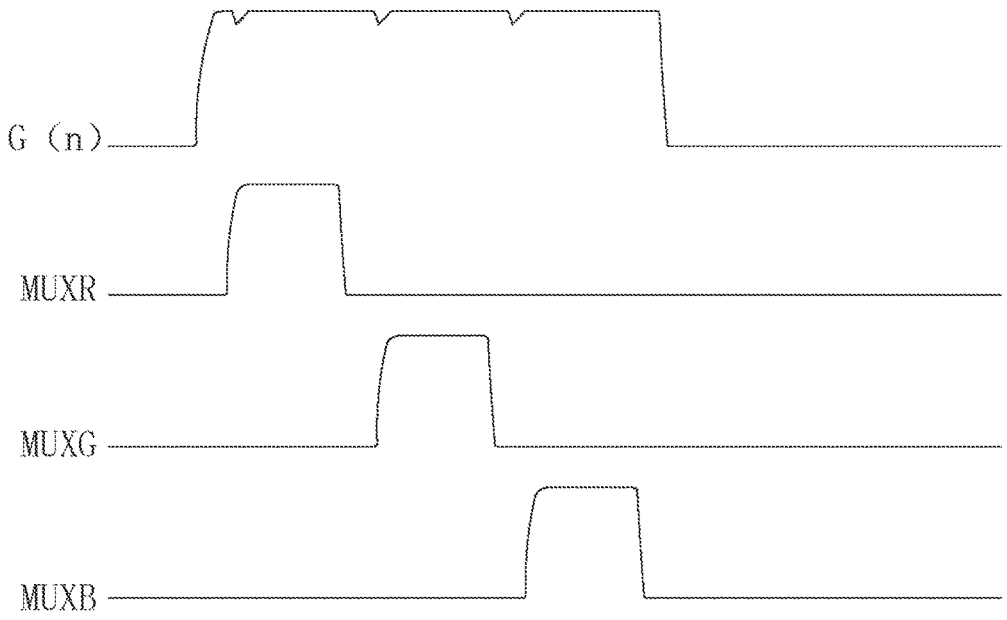
Fig. 3 (PRIOR ART)
FIG. 3 is a actual signal waveform diagram corresponding to the multiplex type display driving circuit according to prior art shown in FIG. 1.
Figure 4:
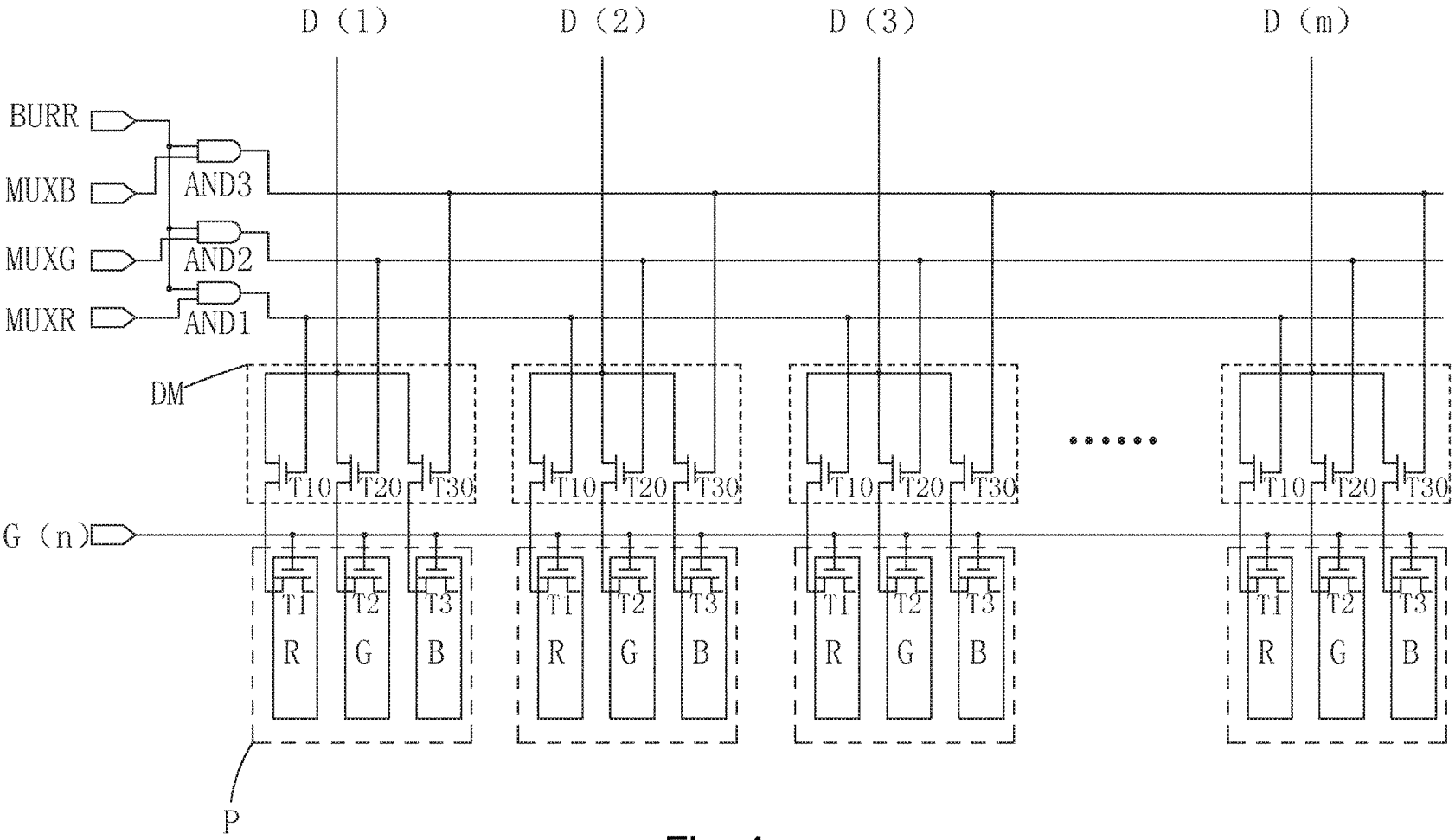
FIG. 4 is a circuit diagram of a display driving circuit of the present invention.

Please refer to FIG. 4. The present invention first provides a display driving circuit, comprising a plurality of pixel units P arranged in array, scan lines set corresponding to each row of pixel units P, data lines set corresponding to each column of pixel units P, multiplex modules DM set corresponding to each column of pixel units P, and a first AND gate AND1, a second AND gate AND2 and a third AND gate AND3.

Two input ends of the first AND gate AND1 respectively receiving a first branch control signal MUXR and a conditioning signal BURR, and two input ends of the second AND gate AND2 respectively receiving a second branch control signal MUXG and a conditioning signal BURR, and two input ends of the third AND gate AND3 respectively receiving a third branch control signal MUXB and a conditioning signal BURR.

Each pixel unit P comprising a red sub pixel R, a green sub pixel G and a blue sub pixel B which are aligned from left to right in order, and a first switch TFT T1 electrically coupled to the red sub pixel R, a second switch TFT T2 electrically coupled to the green sub pixel G, a third switch TFT T3 electrically coupled to the blue sub pixel B; each multiplex module DM comprising a first control TFT T10, a second control TFT T20 and a third control TFT T30 respectively set corresponding to a red sub pixel R column, a green sub pixel G column and a blue sub pixel B column.

n, m are set to be positive integers, and for the pixel unit P of a nth row, a mth column: all of a gate of the first switch TFT T1, a gate of the second switch TFT T2 and a gate of the third switch TFT T3 being electrically coupled to a nth scan line G(n) set corresponding to a nth row of pixel units P, and a source of the first switch TFT T1, a source of the second switch TFT T2 and a source of the third switch TFT T3 being electrically coupled to a drain of the first control TFT T10, a drain of the second control TFT T20 and a drain of the third control TFT T30 in a mth multiplex module DM set corresponding to a mth column of pixel units P, respectively, and a drain of the first switch TFT T10, a drain of the second switch TFT T20 and a drain of the third switch TFT T30 being electrically coupled to the red sub pixel R, the green sub pixel G and the blue sub pixel B, respectively.

For the mth multiplex module DM: a gate of the first control TFT T10, a gate of the second control TFT T20 and a gate of the third control TFT T30 being electrically coupled to an output end of the first AND gate AND1, an output end of the second AND gate AND2 and an output end of the third AND gate AND3, respectively, and all of a source of the first control TFT T10, a source of the second control TFT T20 and a source of the third control TFT T30 being electrically coupled to a mth data line D(m) set corresponding to the mth column of pixel units P.

Figure 5:
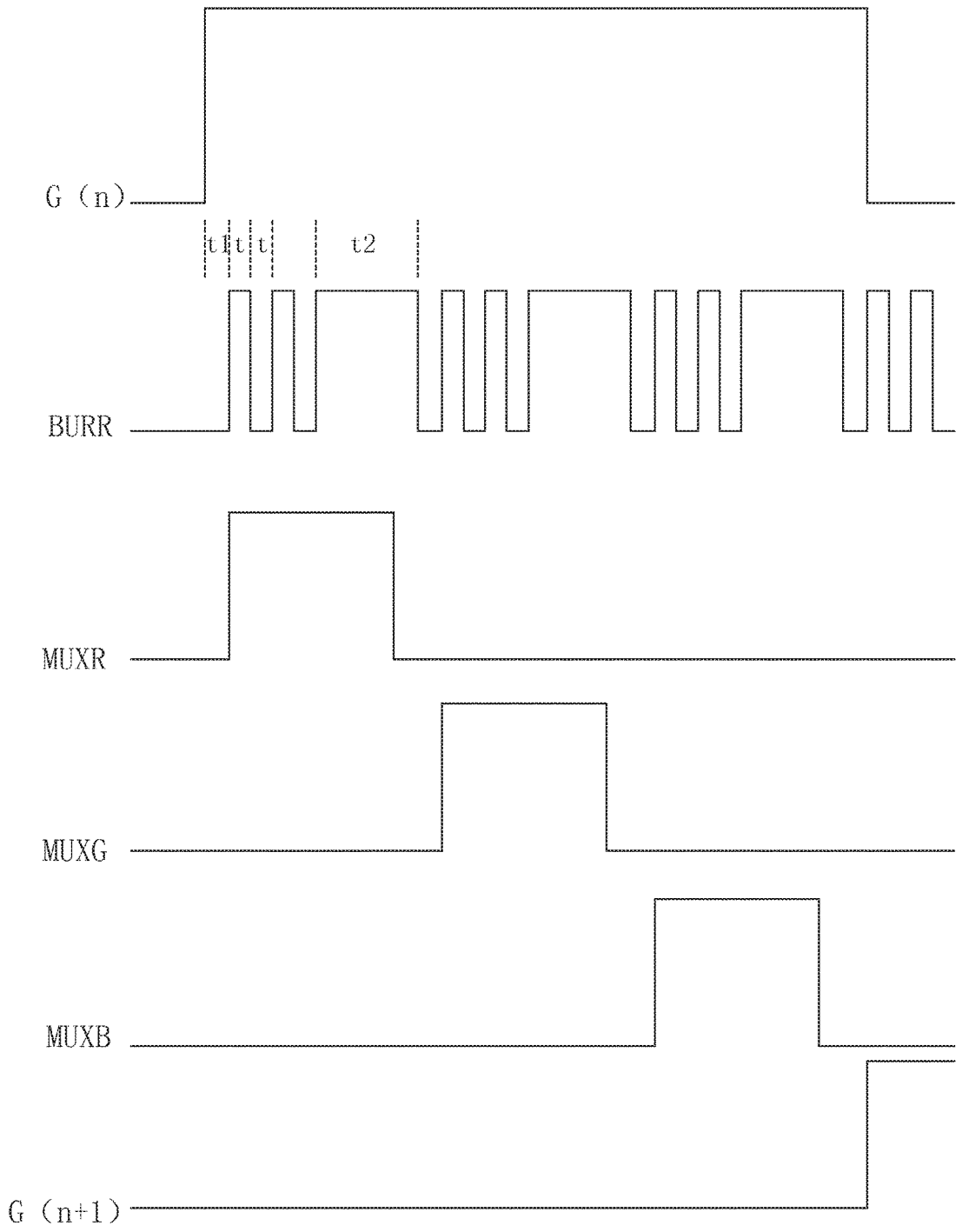
FIG. 5 is a sequence diagram of a display driving circuit of the present invention.
Figure 6:
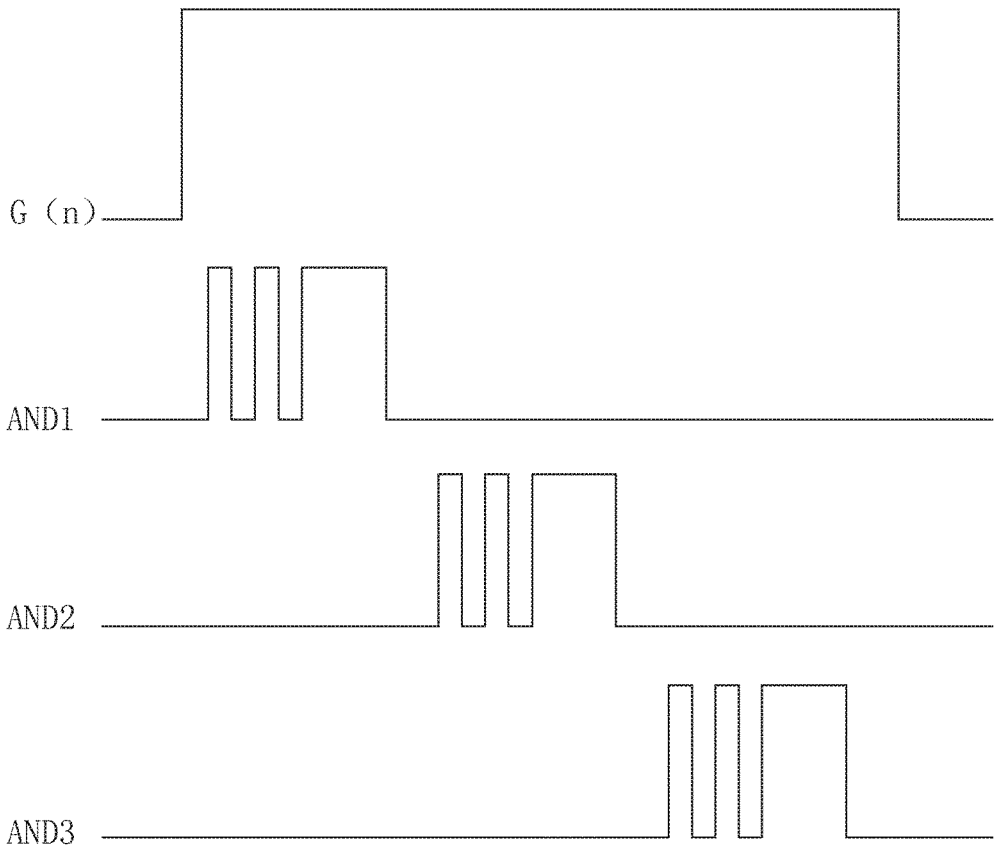
FIG. 6 is a waveform diagram of signals outputted by output ends of a first AND gate, a second AND gate, a third AND gate in a display driving circuit of the present invention.

With Combination of FIG. 5 and FIG. 6, a high voltage level duration of the scan signal in the nth scan line G(n) is larger than a sum of a high voltage level duration of the first branch control signal MUXR, a high voltage level duration of the second branch control signal MUXG and a high voltage level duration of the third branch control signal MUXB; the conditioning signal BURR first performs several high and low voltage level conversions and then maintains the high voltage level, respectively in the high voltage level duration of the first branch control signal MUXR, the high voltage level duration of the second branch control signal MUXG and the high voltage level duration of the third branch control signal MUXB, and correspondingly makes a signal outputted by the output end of the first AND gate AND1, a signal outputted by the output end of the second AND gate AND2 and a signal outputted by the output end of the third AND gate AND3 first perform several high and low voltage level conversions and then maintain the high voltage level.

Specifically, all of the first switch TFT T1, the second switch TFT T2, the third switch TFT T3, the first control TFT T10, the second control TFT T20 and the third control TFT T30 are low temperature poly-silicon TFTs, oxide semiconductor TFTs or amorphous silicon TFTs;

The first branch control signal MUXR, the second branch control signal MUXG and the third branch control signal MUXB are generated in time sequence, and a rising edge of the second branch control signal MUXG is later than a falling edge of the first branch control signal MUXR, and a rising edge of the third branch control signal MUXB is later than a falling edge of the second branch control signal M UXG.

The working procedure of the display driving circuit is:

step 1, the scan signal in the nth scan line G(n) is changed from low to high, all of the first switch TFTs T1, the second switch TFTs T2 and the third switch TFTs T3 of the nth row are on, and after the duration t1, the first branch control signal MUXR and the conditioning signal BURR are pulled high at the same time, and the output end of the first AND gate AND1 outputs a high voltage level signal, then the first control TFTs T10 electrically coupled to the output ends of the first AND gates AND1 are on, and the data signals in the respective data lines start to charge the red sub pixels R of the nth row via the first control TFTs 10 and the first switch TFTs T1 which are on, and the duration is a default duration t;

step 2, then, the conditioning signal BURR is pulled down, and after the first branch control signal MUXR and the conditioning signal BURR passed the first AND gates AND1, the output end of the first AND gate AND1 outputs a low voltage level signal, and the first control TFTs T10 electrically coupled to the output ends of the first AND gates AND1 are off to stop charging the red sub pixels R of the nth row, and the duration is the default duration t.

step 3, repeating step 1 and step 2 several times.

Figure 7:
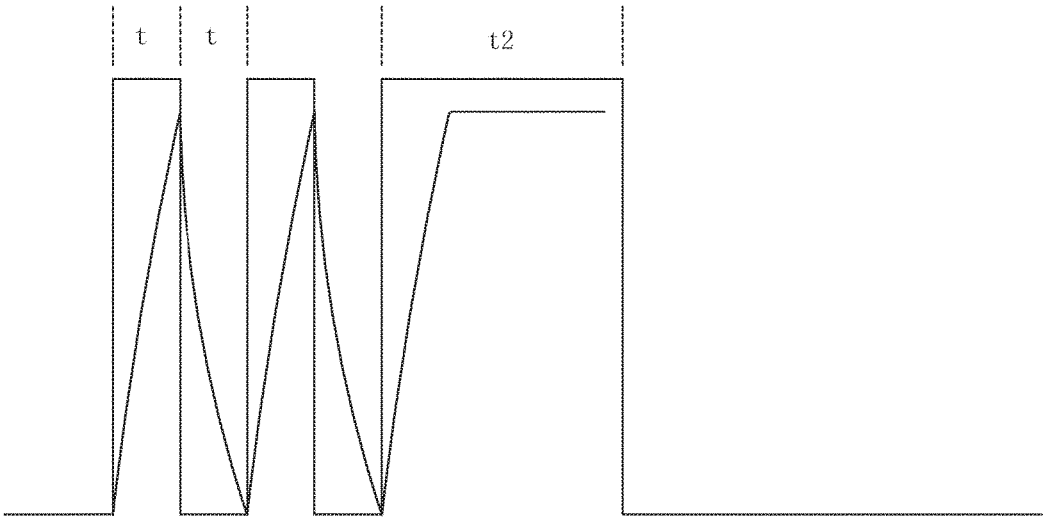
FIG. 7 is a waveform diagram of the respective control TFTs of a display driving circuit of the present invention at the signal near end in the stage that the conditioning signal performs several high and low voltage level conversions, wherein a fine line is an ideal waveform, a thick line is an actual waveform.
Figure 8:
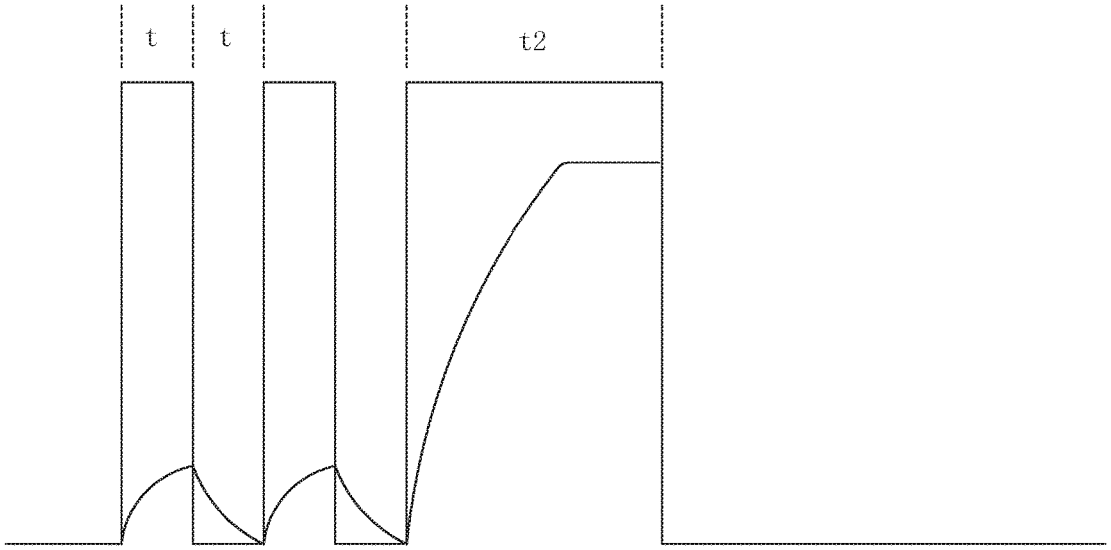
FIG. 8 is a waveform diagram of the respective control TFTs of a display driving circuit of the present invention at the signal remote end in the stage that the conditioning signal performs several high and low voltage level conversions, wherein a fine line is an ideal waveform, a thick line is an actual waveform.

With combination of FIG. 7 and FIG. 8, due to the resistance-capacitance delay (RC Delay) characteristic of the wiring of the circuit itself, as the conditioning signal is in the stage of performing several high and low voltage level conversions and in the duration t as the conditioning signal BURR is briefly pulled high, the on state of the first control TFT T10 of the signal near end is good and the on state of the first control TFT T10 of the signal remote end is bad, and thus charging current of the red sub pixel R of the signal near end is relatively larger than that of the remote end and the charging current of the red sub pixel R of the signal remote end is very small or in the no current state, and after the conditioning signal BURR performed several high and low voltage level conversions, the red sub pixel R of the signal near end basically achieves the charging requirement and the red sub pixel R of the signal remote end has small charge amount change or no change because the on state of the first control TFT T10 is bad to prevent that the signal near end and the signal remote end are both in the large current charging state to reduce the appearance of the instant large current, and thus to avoid the signal glitch formed by the instant overloading to improve the signal quality and to promote the image display quality.

step 4, the conditioning signal BURR continues to be pulled high to maintain the high voltage level to accomplish charging all of the red sub pixels R, and the duration is t2, and t2 is larger than the default duration t.

In the duration t2 that the conditioning signal BURR continues to be pulled high, because the on duration of the first control TFT T10 is relatively longer, both the first control TFTs T10 at the signal near end and the signal remote end are in the better on state, and because the red sub pixel R of the signal near end has already achieved the required charging amount basically, and the current flow is relatively smaller, and the charging speed gets slower, and the red sub pixel R of the signal remote end forms the relatively larger current because the on state of the first control TFT T10 gets better to similarly prevent that the signal near end and the signal remote end are both in the large current charging state to reduce the appearance of the instant large current, and thus to avoid the signal glitch formed by the instant overloading to improve the signal quality and to promote the image display quality.

step 5, similar as step 1 to step 4, the second branch control signal MUXG and the conditioning signal BURR are pulled high at the same time and continue after the default duration t, the conditioning signal BURR is pulled down and then continue in the default duration t, and then repeat is performed several times, and at last, the conditioning signal BURR continues to be pulled high in the duration t2 to accomplish charging all of the green sub pixels G of the nth row to similarly prevent that the signal near end and the signal remote end are both in the large current charging state to reduce the appearance of the instant large current, and thus to avoid the signal glitch formed by the instant overloading to improve the signal quality and to promote the image display quality.

step 6, similar as step 1 to step 4, the third branch control signal MUXB and the conditioning signal BURR are pulled high at the same time and continue after the default duration t, the conditioning signal BURR is pulled down and then continue in the default duration t, and then repeat is performed several times, and at last, the conditioning signal BURR continues to be pulled high in the duration t2 to accomplish charging all of the blue sub pixels B of the nth row to similarly prevent that the signal near end and the signal remote end are both in the large current charging state to reduce the appearance of the instant large current, and thus to avoid the signal glitch formed by the instant overloading to improve the signal quality and to promote the image display quality.

step 7, then, the scan signal in the next scan line is changed from low to high, and the aforesaid step 1 to step 6 are repeated to complete charging the entire LCD.

On the basis of the same inventive idea, the present invention further provides a liquid crystal display panel, comprising the aforesaid display driving circuit, of which the signal glitch is less, and the signal quality is higher, and the image display quality is better. The structure and the working procedure of the display driving circuit are not repeated here.

In conclusion, in the display driving circuit and the liquid crystal display panel of the present invention, on the basis of the present multiplex type display driving circuit, the first AND gate, the second AND gate and the third AND gate are added, and two input ends of the first AND gate respectively receiving a first branch control signal and a conditioning signal, and two input ends of the second AND gate respectively receiving a second branch control signal and a conditioning signal, and two input ends of the third AND gate respectively receiving a third branch control signal and a conditioning signal; the conditioning signal first performs several high and low voltage level conversions and then maintains the high voltage level, respectively in the high voltage level duration of the first branch control signal, the high voltage level duration of the second branch control signal and the high voltage level duration of the third branch control signal, and correspondingly makes a signal outputted by the output end of the first AND gate, a signal outputted by the output end of the second AND gate and a signal outputted by the output end of the third AND gate first perform several high and low voltage level conversions and then maintain the high voltage level. Due to the resistance-capacitance delay characteristic of the wiring of the circuit itself, the first control TFT, the second control TFT, the third control TFT, which are respectively controlled by the signal outputted by the output end of the first AND gate, the signal outputted by the output end of the second AND gate and the signal outputted by the output end of the third AND gate have different on states at the signal near end and at the signal remote end so that the times that the respective sub pixels appear the maximum current at the signal near end and at the signal remote end are not consistent, and thus to avoid the signal glitch formed by the instant overloading to improve the signal quality and to promote the image display quality.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A display driving circuit, comprising a plurality of pixel units arranged in array, scan lines set corresponding to each row of pixel units, data lines set corresponding to each column of pixel units, multiplex modules set corresponding to each column of pixel units, and a first AND gate, a second AND gate and a third AND gate;

two input ends of the first AND gate respectively receiving a first branch control signal and a conditioning signal, and two input ends of the second AND gate respectively receiving a second branch control signal and a conditioning signal, and two input ends of the third AND gate respectively receiving a third branch control signal and a conditioning signal;

each pixel unit comprising a red sub pixel, a green sub pixel and a blue sub pixel which are aligned from left to right in order, and a first switch TFT electrically coupled to the red sub pixel, a second switch TFT electrically coupled to the green sub pixel, a third switch TFT electrically coupled to the blue sub pixel; each multiplex module comprising a first control TFT, a second control TFT and a third control TFT respectively set corresponding to a red sub pixel column, a green sub pixel column and a blue sub pixel column;

n, m are set to be positive integers, and for the pixel unit of a nth row, a mth column: all of a gate of the first switch TFT, a gate of the second switch TFT and a gate of the third switch TFT being electrically coupled to a nth scan line set corresponding to a nth row of pixel units, and a source of the first switch TFT, a source of the second switch TFT and a source of the third switch TFT being electrically coupled to a drain of the first control TFT, a drain of the second control TFT and a drain of the third control TFT in a mth multiplex module set corresponding to a mth column of pixel units, respectively, and a drain of the first switch TFT, a drain of the second switch TFT and a drain of the third switch TFT being electrically coupled to the red sub pixel, the green sub pixel and the blue sub pixel, respectively;

for the mth multiplex module: a gate of the first control TFT, a gate of the second control TFT and a gate of the third control TFT being electrically coupled to an output end of the first AND gate, an output end of the second AND gate and an output end of the third AND gate, respectively, and all of a source of the first control TFT, a source of the second control TFT and a source of the third control TFT being electrically coupled to a mth data line set corresponding to the mth column of pixel units.

2. The display driving circuit according to claim 1, wherein a high voltage level duration of the scan signal in the nth scan line is larger than a sum of a high voltage level duration of the first branch control signal, a high voltage level duration of the second branch control signal and a high voltage level duration of the third branch control signal; the conditioning signal first performs several high and low voltage level conversions and then maintains the high voltage level, respectively in the high voltage level duration of the first branch control signal, the high voltage level duration of the second branch control signal and the high voltage level duration of the third branch control signal, and correspondingly makes a signal outputted by the output end of the first AND gate, a signal outputted by the output end of the second AND gate and a signal outputted by the output end of the third AND gate first perform several high and low voltage level conversions and then maintain the high voltage level.

3. The display driving circuit according to claim 2, wherein in a process that the conditioning signal performs several high and low voltage level conversions, both a high voltage level duration and a low voltage level duration are default durations.

4. The display driving circuit according to claim 2, wherein the first branch control signal, the second branch control signal and the third branch control signal are generated in time sequence, and a rising edge of the second branch control signal is later than a falling edge of the first branch control signal, and a rising edge of the third branch control signal is later than a falling edge of the second branch control signal.

5. The display driving circuit according to claim 1, wherein all of the first switch TFT, the second switch TFT, the third switch TFT, the first control TFT, the second control TFT and the third control TFT are low temperature poly-silicon TFTs, oxide semiconductor TFTs or amorphous silicon TFTs.

6. A liquid crystal display panel, comprising a display driving circuit, and the display driving circuit comprising a plurality of pixel units arranged in array, scan lines set corresponding to each row of pixel units, data lines set corresponding to each column of pixel units, multiplex modules set corresponding to each column of pixel units, and a first AND gate, a second AND gate and a third AND gate;

two input ends of the first AND gate respectively receiving a first branch control signal and a conditioning signal, and two input ends of the second AND gate respectively receiving a second branch control signal and a conditioning signal, and two input ends of the third AND gate respectively receiving a third branch control signal and a conditioning signal;

each pixel unit comprising a red sub pixel, a green sub pixel and a blue sub pixel which are aligned from left to right in order, and a first switch TFT electrically coupled to the red sub pixel, a second switch TFT electrically coupled to the green sub pixel, a third switch TFT electrically coupled to the blue sub pixel; each multiplex module comprising a first control TFT, a second control TFT and a third control TFT respectively set corresponding to a red sub pixel column, a green sub pixel column and a blue sub pixel column;

n, m are set to be positive integers, and for the pixel unit of a nth row, a mth column: all of a gate of the first switch TFT, a gate of the second switch TFT and a gate of the third switch TFT being electrically coupled to a nth scan line set corresponding to a nth row of pixel units, and a source of the first switch TFT, a source of the second switch TFT and a source of the third switch TFT being electrically coupled to a drain of the first control TFT, a drain of the second control TFT and a drain of the third control TFT in a mth multiplex module set corresponding to a mth column of pixel units, respectively, and a drain of the first switch TFT, a drain of the second switch TFT and a drain of the third switch TFT being electrically coupled to the red sub pixel, the green sub pixel and the blue sub pixel, respectively;

for the mth multiplex module: a gate of the first control TFT, a gate of the second control TFT and a gate of the third control TFT being electrically coupled to an output end of the first AND gate, an output end of the second AND gate and an output end of the third AND gate, respectively, and all of a source of the first control TFT, a source of the second control TFT and a source of the third control TFT being electrically coupled to a mth data line set corresponding to the mth column of pixel units.

7. The liquid crystal display panel according to claim 6, wherein a high voltage level duration of the scan signal in the nth scan line is larger than a sum of a high voltage level duration of the first branch control signal, a high voltage level duration of the second branch control signal and a high voltage level duration of the third branch control signal; the conditioning signal first performs several high and low voltage level conversions and then maintains the high voltage level, respectively in the high voltage level duration of the first branch control signal, the high voltage level duration of the second branch control signal and the high voltage level duration of the third branch control signal, and correspondingly makes a signal outputted by the output end of the first AND gate, a signal outputted by the output end of the second AND gate and a signal outputted by the output end of the third AND gate first perform several high and low voltage level conversions and then maintain the high voltage level.

8. The liquid crystal display panel according to claim 7, wherein in a process that the conditioning signal performs several high and low voltage level conversions, both a high voltage level duration and a low voltage level duration are default durations.

9. The liquid crystal display panel according to claim 7, wherein the first branch control signal, the second branch control signal and the third branch control signal are generated in time sequence, and a rising edge of the second branch control signal is later than a falling edge of the first branch control signal, and a rising edge of the third branch control signal is later than a falling edge of the second branch control signal.

10. The liquid crystal display panel according to claim 6, wherein all of the first switch TFT, the second switch TFT, the third switch TFT, the first control TFT, the second control TFT and the third control TFT are low temperature poly-silicon TFTs, oxide semiconductor TFTs or amorphous silicon TFTs.

11. A liquid crystal display panel, comprising a display driving circuit, and the display driving circuit comprising a plurality of pixel units arranged in array, scan lines set corresponding to each row of pixel units, data lines set corresponding to each column of pixel units, multiplex modules set corresponding to each column of pixel units, and a first AND gate, a second AND gate and a third AND gate;

two input ends of the first AND gate respectively receiving a first branch control signal and a conditioning signal, and two input ends of the second AND gate respectively receiving a second branch control signal and a conditioning signal, and two input ends of the third AND gate respectively receiving a third branch control signal and a conditioning signal;

each pixel unit comprising a red sub pixel, a green sub pixel and a blue sub pixel which are aligned from left to right in order, and a first switch TFT electrically coupled to the red sub pixel, a second switch TFT electrically coupled to the green sub pixel, a third switch TFT electrically coupled to the blue sub pixel; each multiplex module comprising a first control TFT, a second control TFT and a third control TFT respectively set corresponding to a red sub pixel column, a green sub pixel column and a blue sub pixel column;

n, m are set to be positive integers, and for the pixel unit of a nth row, a mth column: all of a gate of the first switch TFT, a gate of the second switch TFT and a gate of the third switch TFT being electrically coupled to a nth scan line set corresponding to a nth row of pixel units, and a source of the first switch TFT, a source of the second switch TFT and a source of the third switch TFT being electrically coupled to a drain of the first control TFT, a drain of the second control TFT and a drain of the third control TFT in a mth multiplex module set corresponding to a mth column of pixel units, respectively, and a drain of the first switch TFT, a drain of the second switch TFT and a drain of the third switch TFT being electrically coupled to the red sub pixel, the green sub pixel and the blue sub pixel, respectively;

for the mth multiplex module: a gate of the first control TFT, a gate of the second control TFT and a gate of the third control TFT being electrically coupled to an output end of the first AND gate, an output end of the second AND gate and an output end of the third AND gate, respectively, and all of a source of the first control TFT, a source of the second control TFT and a source of the third control TFT being electrically coupled to a mth data line set corresponding to the mth column of pixel units;

wherein a high voltage level duration of the scan signal in the nth scan line is larger than a sum of a high voltage level duration of the first branch control signal, a high voltage level duration of the second branch control signal and a high voltage level duration of the third branch control signal; the conditioning signal first performs several high and low voltage level conversions and then maintains the high voltage level, respectively in the high voltage level duration of the first branch control signal, the high voltage level duration of the second branch control signal and the high voltage level duration of the third branch control signal, and correspondingly makes a signal outputted by the output end of the first AND gate, a signal outputted by the output end of the second AND gate and a signal outputted by the output end of the third AND gate first perform several high and low voltage level conversions and then maintain the high voltage level;

wherein all of the first switch TFT, the second switch TFT, the third switch TFT, the first control TFT, the second control TFT and the third control TFT are low temperature poly-silicon TFTs, oxide semiconductor TFTs or amorphous silicon TFTs.

12. The liquid crystal display panel according to claim 11, wherein in a process that the conditioning signal performs several high and low voltage level conversions, both a high voltage level duration and a low voltage level duration are default durations.

13. The liquid crystal display panel according to claim 11, wherein the first branch control signal, the second branch control signal and the third branch control signal are generated in time sequence, and a rising edge of the second branch control signal is later than a falling edge of the first branch control signal, and a rising edge of the third branch control signal is later than a falling edge of the second branch control signal.

* * * * *